United States Patent [19]

Preston

[11] 3,992,490

[45] Nov. 16, 1976

[54] METHOD AND MEANS OF ADJUSTMENT CONTROL FOR CHARGE FORMING APPARATUS

[75] Inventor: Walter P. Preston, Toledo, Ohio

[73] Assignee: Borg-Warner Corporation, Chicago, Ill.

[22] Filed: Aug. 3, 1972

[21] Appl. No.: 277,637

[52] U.S. Cl. ..... 261/41 D; 261/DIG. 38; 261/DIG. 68; 151/7

[51] Int. Cl.[2] ..... F02M 17/04

[58] Field of Search ..... 261/41 D, 65, 34 A, 261/DIG. 38, DIG. 68; 151/7

[56] References Cited

UNITED STATES PATENTS

| | | | |
|---|---|---|---|
| 2,462,603 | 2/1949 | Boots | 151/7 |
| 2,481,762 | 9/1949 | Lewis | 151/7 |
| 2,520,121 | 8/1950 | Brutus | 151/7 |
| 2,520,122 | 8/1950 | Brutus | 151/7 |
| 3,208,739 | 9/1965 | Phillips | 261/DIG. 68 |
| 3,414,244 | 12/1968 | Patterson, Jr. | 261/DIG. 38 |
| 3,484,084 | 12/1969 | Simpson et al. | 261/DIG. 38 |

*Primary Examiner*—Frank T. Yost
*Attorney, Agent, or Firm*—Harry O. Ernsberger

[57] ABSTRACT

The disclosure embraces relatively movable or adjustable members or elements forming control components of a charge forming apparatus or carburetor wherein one or more members or elements are adjustable or movable relative to a mounting means, the disclosure embracing a method and arrangement wherein substantially spherical bodies or balls of deformable resinous or plastic material associated with the movable members or elements are disposed to establish a substantially constant amount or degree of friction between a mounting means and one or more of the movable or adjustable members or elements to assure retention of the movable members or elements in adjusted positions.

31 Claims, 28 Drawing Figures

METHOD AND MEANS OF ADJUSTMENT CONTROL FOR CHARGE FORMING APPARATUS

The invention relates to relatively adjustable or movable control members or elements and more especially to fuel flow adjusting devices, throttle valve position adjusting means and choke valve control associated with or embodied in a charge forming apparatus or carburetor of the character for supplying a fuel and air mixture to an internal combustion engine and to a method and arrangement of establishing friction for retaining control members or elements in adjusted positions.

It has heretofore been a usual practice in carburetors or charge forming apparatus to utilize adjustable threaded valve members or elements for regulating fuel flow through passages into a carburetor mixing passage and to utilize threaded members or screws for adjusting the engine idling position of the throttle valve. In such arrangements coil springs embracing the screws or threaded members have been employed disposed between heads of the threaded members and a component or body of the carburetor to exert resilient pressure on the threaded members for the purpose of setting up friction to maintain the threaded members or control devices in desired adjusted positions.

It is well known that internal combustion engines with which charge forming apparatus of carburetors are used develop vibrations particularly at certain engine speeds and as the carburetor or charge forming apparatus is mounted by the internal combustion engine with which it is used, engine vibrations are transmitted to the carburetors or charge forming apparatus. Thus, at certain speeds in engine operation, the carburetor or charge forming apparatus is caused to be vibrated and such vibration may be of a magnitude in many instances to overcome the friction established by the coil springs whereby the adjustable threaded members or elements may be vibrated and thereby moved out of adjustment.

It has also been conventional practice in a charge forming apparatus or carburetor equipped with a choke valve mounted on a movable shaft or element to employ a metal ball under spring pressure engaged with the shaft or element for resiliently retaining the choke valve in adjusted positions.

The invention embraces an arrangement associated with a relatively movable or adjustable member or element in a charge forming apparatus or carburetor for establishing and maintaining a substantially constant amount of friction resisting relative movement or adjustment of the member or element whereby the same may be maintained in a desired position of adjustment. The invention embraces an arrangement in a charge forming apparatus or carburetor embodying a first member mounted in an opening in a second member for movement or adjustment relative to the second member including a body or element of distortable material associated with one of said members and having a spherical-shaped surface engageable with the other member for establishing and maintaining a substantially constant amount or degree of friction resisting relative movement of the first member relative to the second member.

The invention embraces a method of establishing friction between one component and a relatively movable component of a charge forming apparatus for holding the relatively movable component in adjusted positions including utilizing a deformable resinous body disposed to effect normal interference between the components and wherein the assembly of one component with the other engages and deforms the resinous body establishing lateral pressure between the components providing a degree of friction effective to hold the relatively movable component in adjusted positions.

An object of the invention resides in an arrangement associated with an adjustable member threaded into an internally threaded opening in a body or component, the arrangement embodying a spherical member of distortable material associated with the interengaging threads of the member and threaded opening in the body or component for establishing and maintaining a substantially constant amount of friction for retaining the threaded member in all positions of adjustment.

Another object of the invention resides in the mounting of an externally threaded first member in a threaded opening in a second member in combination with a spherical member of distortable material engageable with the threads of one of the members for establishing and maintaining a substantially constant amount of friction between the members for maintaining the first member in all positions of adjustment with respect to the second member.

The invention embraces a method and an arrangement or construction wherein a first member mounted in an opening in a second member is movable relative to the second member and a spherical element or body of distoratable material associated with the second member is engaged with and distorted by a smooth surface of the first member for establishing a substantially constant amount of friction for retaining the first member in adjusted positions.

Another object of the invention embraces a charge forming apparatus or carburetor having a fuel and air mixing passage with a relatively movable throttle valve associated with the mixing passage, the construction embodying a threaded member for adjusting the throttle valve in an engine idling position, the threaded member being received in a threaded bore and a spherical member of distortable material associated with the interengaging threads of the members for establishing and maintaining a substantially constant amount of friction for retaining the threaded member in all positions for adjustment.

Another object of the invention embraces a charge forming apparatus or carburetor having a body construction embodying a fuel and air mixing passage and a fuel chamber, the body having passage means for conveying fuel from the fuel chamber to a main fuel delivery orifice and to a supplemental orifice for engine idling purposes, the body construction having threaded adjustable members for adjusting or controlling fuel delivery to the main and supplemental orifices, and a spherical element or distortable material associated with each of the adjustable members for establishing and maintaining a substantially constant amount of friction for retaining each of the threaded members in all positions of adjustment.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawing of a form of the invention, which may be preferred, in which.

Figure 1:
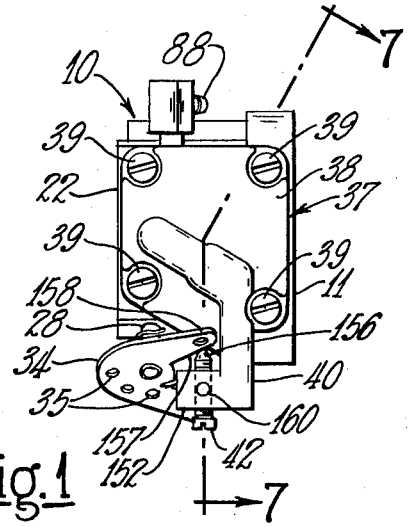
FIG. 1 is a top plan view of a combined carburetor and fuel pump construction embodying a form of the invention.

The invention has been illustrated as embodied in combined carburetor and fuel pump construction, the carburetors being of the aspirated diaphragm type of a character particularly usable with low horsepower engines and more especially engines of the two cycle type employed for powering chain saws, lawnmowers and the like.

It is to be understood that the invention may be embodied in various types and sizes of carburetors for providing a substantially constant amount of friction upon relatively movable or adjustable members such as needle valves for adjusting or regulating fuel flow, for abutment screws or members employed for adjusting the engine idling position of a throttle valve, for retaining a choke valve in positions of adjustment, for frictionally retaining relatively movable members in desired positions or wherever the invention may be found to have utility.

The carburetor and fuel pump construction illustrated in FIGS. 1 through 8 is of comparatively small compact construction and had particular utility for use with chain saw engines where it is imperative to minimize weight, the carburetor construction being of the aspirated diaphragm type of a character which is operable in all angular positions including inverted position, a necessary requisite for successful chain saw operation. FIGS. 1 through 5 illustrate one form of carburetor and fuel pump construction in substantially actual size, the construction being especially adapted for use with a two cycle engine for operating a chain saw.

Referring initially to FIGS. 1 through 8, the combined charge forming apparatus or carburetor and fuel pump construction 10 is inclusive of a carburetor body or body member 11 preferably die cast of metal such as an alloy of aluminum, an alloy of zinc or other suitable metal. The body or member 11 is of generally cubical shape and is provided with an air and fuel mixing passage 12, shown in FIGS. 6 and 7, the mixing passage having an air inlet region 14 and a mixture outlet region 16.

The mixing passage 12 is inclusive of a Venturi-shaped configuration 18, the air inlet region 14 being defined by a curved configuration or partial toroidal shape 20. The mixture outlet end of the carburetor body has a uniplanar mounting surface 22 which is adapted for mounting the carburetor body on an intake manifold 24 for conveying fuel and air mixture to the crankcase of a two cycle engine. A gasket or member 26 of heat resistant insulating material may be disposed between the manifold 24 and the carburetor body.

Journaled in aligned bores in the wall zone of the body 11 defining the mixture outlet region 16 is a throttle shaft 28. The portion of the throttle shaft within the mixture outlet 16 has a flat surface 29 on which is mounted a disc-type throttle or throttle valve 30 secured to the shaft by a screw 31. The throttle shaft 28 is rotatable to vary the position of the throttle valve 30 to control the flow of fuel and air mixture to the engine.

An end of the throttle shaft 28 exteriorly of the carburetor body 11 is equipped with a disc-like member or plate 34, the plate being secured on the shaft by swaging the end region of the shaft. The plate is provided with openings 35 and a throttle operating rod 36 has an end region engageable in a selected opening 35 for manipulating the shaft 28 and the throttle valve 30. The throttle shaft 28 is restrained against endwise movement by a U-shaped retainer 32 secured in place by a screw 33.

Secured to the carburetor body and forming a component of a diaphragm type fuel pump construction 37 is a pump body 38 secured to the carburetor body 11 by screws 39. The pump body 38 is fashioned with an L-shaped projection 40 supporting an abutment means in the form of a threaded member or screw 42 which is adapted to be engaged by the plate 34, the member or screw being adjustable for regulating the extent of opening of the throttle valve 30 in engine idling position. The mounting for the threaded member 42 for adjusting the engine idling position of the throttle valve will be hereinafter described in detail.

Figure 2:
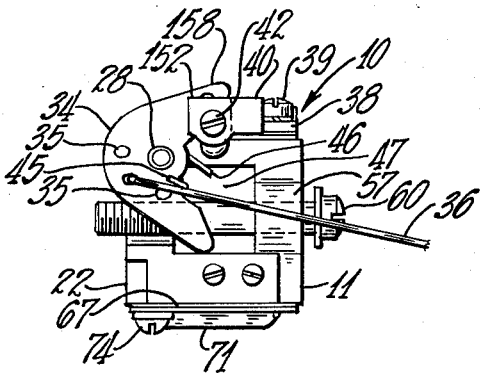
FIG. 2 is a view of one side of the construction shown in FIG. 1.
Figure 4:
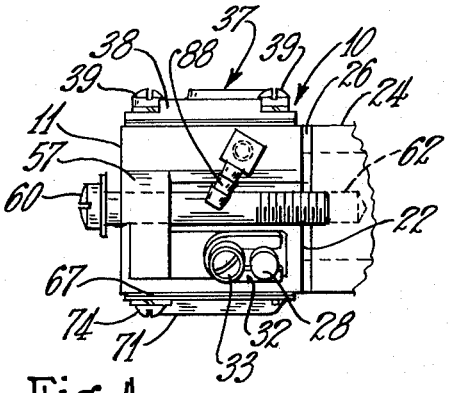
FIG. 4 is an elevational view of the opposite side of the carburetor and fuel pump construction.
Figure 5:
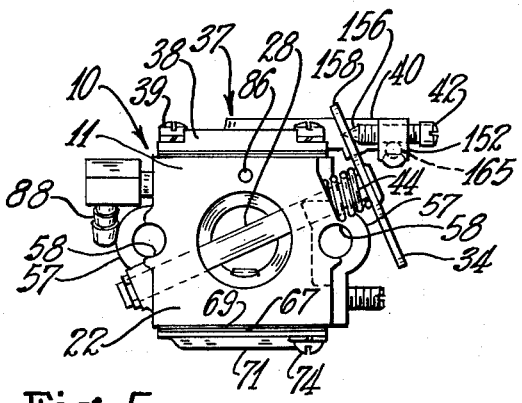
FIG. 5 is an elevational view of the opposite or mixture outlet end of the carburetor.

A coil spring 44, surrounding the throttle shaft 28 exteriorly of the body 11 has one end 45 hooked over the plate 34, the other end 46 of the spring being engaged in a recess 47 in the carburetor body or member 11 as shown in FIG. 2. The coil spring 44 normally biases the plate or member 34 in a direction urging the throttle valve 30 toward near closed or engine idling position shown in FIG. 6.

Figure 6:
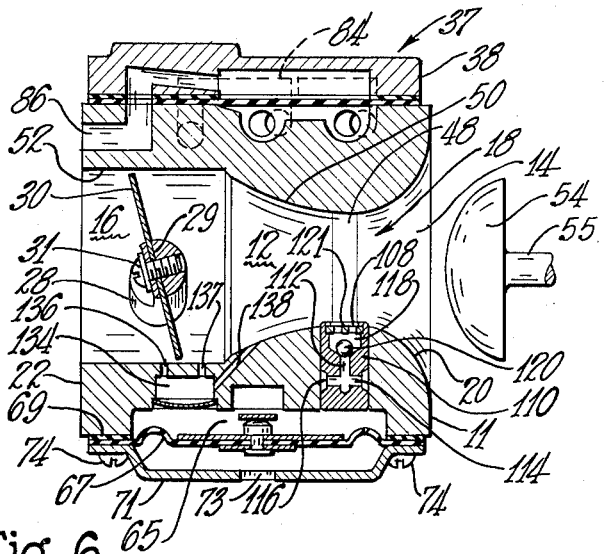
FIG. 6 is an enlarged longitudinal sectional view through the carburetor on the longitudinal axis of the mixing passage.

The configuration defining the mixing passage 12 is inclusive of the partial toroidal surface 20 at the air inlet region 14, the surface 20 providing at its small diameter a choke band 48 which mates or blends with a curved surface of revolution 50, the larger diameter of the latter curvature being joined with a cylindrical surface 52 defining the mixture outlet region 16 of the mixing passage. Means may be provided for temporarily obstructing the air 14 for engine starting purpose. As shown in FIG. 6, a partial sperically-shaped or dome-like member 54 mounted on rod 55 is arranged for movement axially of the rod and the axis of the mixing passage, the rod being supported in any suitable manner (not shown).

When the dome-shaped member 54 is engaged with the surface 20, the air inlet is obstructed, the arrangement functioning as a choke means. It is to be understood that other relatively movable means may be employed for obstructing the air inlet region 14 for engine starting purposes. The means for securing the carburetor body to the manifold 24 is of a character to minimize the transmission or conduction of heat from an engine crankcase wall to the carburetor body.

Figure 3:
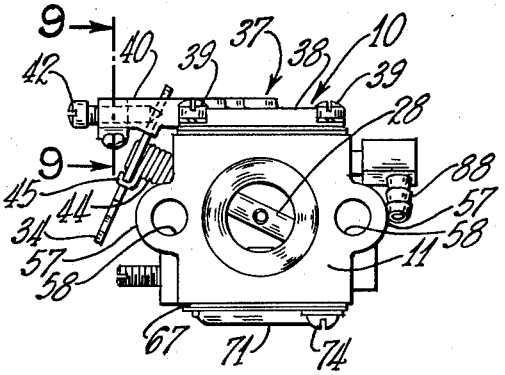
FIG. 3 is an elevational view of the air inlet end of the construction.

Integrally formed with the body 11 at the air inlet region are laterally projecting bosses 57 provided with bores 58, the bores accommodating mounting bolts 60 which are threaded into bores 62 provided in the end region of the manifold 24. As shown in FIGS. 2 and 3, the boss portions 57 are approximately one-third the length of the carburetor body whereby a substantial length of each of the mounting bolts 60 is exposed to the ambient air to effect a cooling of the bolts.

Figure 7:
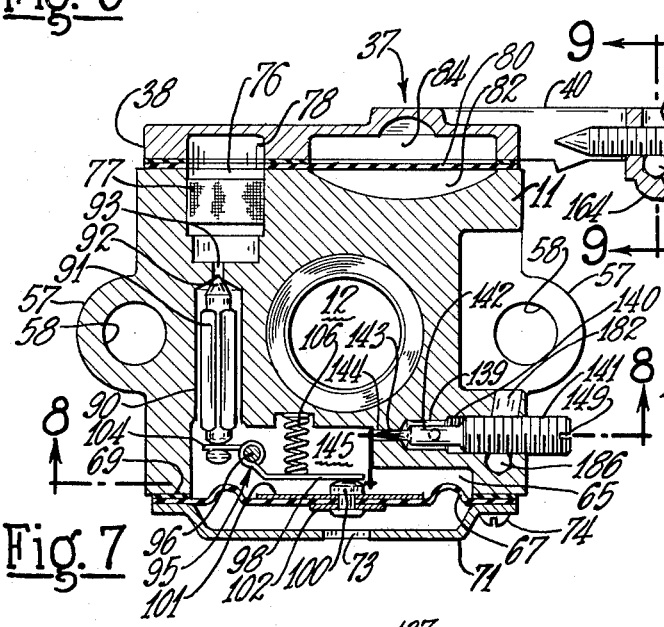
FIG. 7 is an enlarged transverse sectional view taken substantially on the line 7—7 of FIG. 1.
Figure 8:
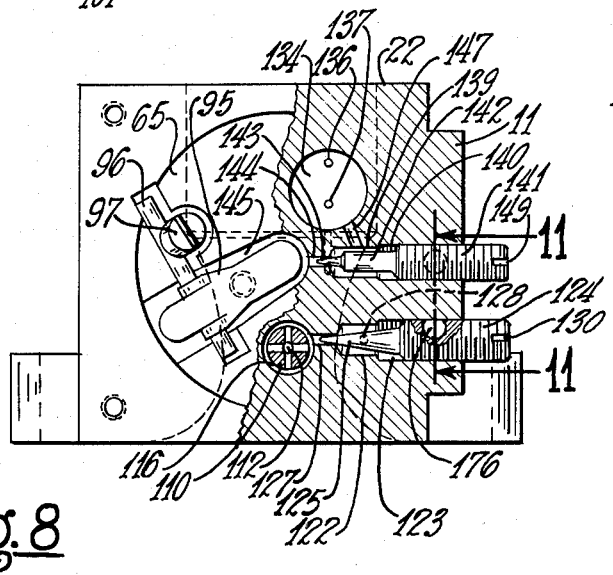
FIG. 8 is an enlarged sectional view taken substantially on the line 8—8 of FIG. 7.

With particular reference to FIGS. 6 through 8, the carburetor body 11 is fashioned with a substantially circular recess providing a fuel chamber 65, a flexible member or diaphragm 67 extending across the recess and forming one wall of the fuel chamber 65. An annular gasket 69 is disposed between the periphery of the diaphragm and the planar surface of a portion of the carburetor body defining the fuel chamber 65.

A cover member 71 is disposed adjacent the diaphragm as shown in FIGS. 6 and 7 and is configurated with a depressed central region to accommodate flexing of the diaphragm 67, the cover having a vent opening 73. Screws 74 extend through registering openings in the cover member 71, diaphragm 67 and gasket 69 and are threaded into openings in the body member 11 to secure these components in the positions shown in FIGS. 6 and 7.

The diaphragm 67 is adapted to be flexed or actuated by reduced pressure, suction or engine aspiration in the mixing passage 12 for controlling the delivery of liquid fuel from a supply into the fuel chamber 65. The body member 11 is fashioned with a fuel inlet passage 76 and disposed in the passage is a fuel filter or screen 77. The duct or passage 76 is in communication with a fuel delivery channel 78 provided in the pump body or plate 38.

The pump construction 37 includes a pumping diaphragm 80, a fuel receiving chamber 82 formed in the body 11 at one side of the diaphragm 80 and a pulse or pumping chamber 84 formed in the pump body or plate 38. The pumping or pulse chamber 84 is connected with a pulse channel 86 which opens at the mounting face 22 of the body 11 into the intake manifold 24 leading into the crankcase of the two cycle engine whereby the varying fluid pressure in the crankcase flexes or vibrates the pumping diaphragm 80.

A nipple 88 mounted in an opening in the carburetor body is adapted to be connected by a tube (not shown) with a fuel supply tank (not shown). The pump diaphragm 80 is fashioned with flap valves (not shown) for cooperating with ports in communication with the fuel chamber 82 whereby liquid fuel is pumped by flexing movement of the diaphragm 80 from the fuel supply tank into the chamber 82 and from the chamber 82 to the fuel inlet passage 76 in the body 11.

As shown in FIG. 7, a bore 90 in the carburetor body 11 accommodates a fuel inlet valve body 91 slidably disposed in the bore. The valve body 91 is of polygonal cross section, and one end of the valve body is fashioned with a needle valve portion 92 cooperating with a fuel inlet port 93 opening into the inlet duct 76. A lever 95, disposed in the fuel chamber 65, is pivoted on a fulcrum pin 96, the fulcrum pin being secured to the carburetor body 11 by a retaining screw 97. The long arm 98 of the lever 95 is adapted for engagement with a button-like member 100 secured to the central region of the diaphragm 67 and extending through openings in reinforcing discs 101 and 102.

The short arm 104 of the lever 95 has operative engagement with the lower end of the inlet valve body 91, as shown in FIG. 7. An expansive coil spring 106 engaging the long arm 98 of the lever normally biases the lever for movement in a clockwise direction about the fulcrum pin 96 urging the needle valve portion 92 of the valve body 91 to close the fuel inlet port 93. Through this arrangement flexing movements of the metering diaphragm 67 under the influence of aspiration in the mixing passage 12 actuate the valve 92 to control fuel flow through the port 93 into the fuel chamber 65.

The carburetor or charge forming apparatus includes a main or primary fuel delivery system and a secondary or engine idling and low speed fuel delivery system. The main or primary fuel delivery system is inclusive of a main orifice 108 provided by a fitting 110 disposed in a bore in the carburetor body as illustrated in FIG. 6. The fitting 110 is fashioned with a central fuel passage or well 112 which is in communication with cross channels 114, the cross channels being in communication with a peripheral channel 116.

The fitting 110 is fashioned with a chamber or counterbore 118 accommodating a relatively movable, spherical member or ball 120, the ball being prevented from dislodgment from the fitting by a grid 121, the interstices provided by the grid constituting the main fuel delivery orifice 108. When the engine idling and low speed fuel delivery system is in operation, the ball valve 120 closes the passage 112 to prevent back bleeding of air through the main orifice 108 into the secondary fuel delivery system.

The carburetor body 11 is fashioned with a bore 122 having a threaded portion 123 which receives a threaded member or valve body 124, the body having a needle valve portion 125 which extends through the bore 122 into a restricted fuel passage 127. The bore 122 receives fuel from the fuel chamber 65 through a passage 128, shown in broken lines in FIG. 8, the fuel for normal and high speed engine operation flowing past the needle valve 125 through passage 127, through the peripheral channel 116, transverse passage 114 and through passage or well 112 and chamber 118 thence through the main orifice. The outer end of the valve body 124 is provided with a slot or kerf 130 to receive a manipulating tool for adjusting the needle valve 125.

The secondary fuel delivery system for engine idling and low speed operation includes a supplemental chamber 134 in the carburetor body. An engine idling orifice 136 and a low speed orifice 137, in communication with the supplemental fuel chamber 134, open into the mixing passage as shown in FIG. 6. As shown in FIGS. 7 and 8, the body 11 is fashioned with a bore 139 having a threaded portion 140 accommodating the threaded portion of the member or valve body 141.

The valve body 141 has a tenon portion 142 provided with a needle valve portion 143 extending into and cooperating with a restricted passage 144, the latter opening into a recess 145 of the fuel chamber 65 to receive fuel from the chamber 65. The supplemental chamber 134 is in communication with the bore 139 by a passage 147. The outer end of the valve body or member 141 is fashioned with a slot or kerf 149 to accommodate a suitable tool for adjusting the valve body 141 and the needle valve 143.

The operation of the carburetor shown in FIGS. 1 through 8 is as follows: Assuming that the carburetor has been previously operated and the fuel chamber 65 is filled with liquid fuel, the operator closes the air inlet entrance 14 in the carburetor by moving the member of valve 54 lengthwise in a left-hand direction as viewed in FIG. 6. The engine is then cranked by the operator with the throttle valve 30 in partial or full open position.

With the air inlet 14 substantially closed by the member 54, engine aspiration set up in the mixing passage is effective to aspirate fuel from the chamber 55 through passage 128, past the needle valve 125 through passage 127 and through the channels and passages in the fitting 110, the fuel being discharged through the main orifice 108, thus starting the engine. Upon starting the engine, the choke valve or member 54 is moved away from the air inlet 14 of the carburetor to admit air into the mixing passage.

The aspiration in the mixing passage effects delivery of fuel through the main orifice and reduces the pressure in the fuel chamber 65, the reduced pressure flexing the metering diaphragm 67 upwardly, as viewed in FIGS. 6 and 7, swinging the lever 95 about the fulcrum 96 in a counterclockwise direction whereby the inlet valve 91 and the needle valve portion 92 are moved downwardly, opening the inlet port 93.

Fuel flows past the inlet valve 92 into the fuel chamber 65 substantially at the rate at which the fuel is aspirated into the mixing passage through the main orifice 108 or through the engine idling and low speed orifices 136 and 137. The rate of fuel delivery to the main orifice is regulated or controlled by the manually operated needle valve 125.

When the throttle valve 30 is moved to near closed or engine idling position, as shown in FIG. 6, fuel for engine idling operation flows from the fuel chamber 65 through passage 144 past the needle valve 143 into the bore 139, thence through the passage 147 into the supplemental chamber 134 and through the engine idling orifice 136 at the downstream side of the throttle valve 30. An air bleed passage 138, shown in FIG. 6, may be provided in communication with the mixing passage and the supplemental chamber 134 for admitting a restricted amount of air into the supplemental chamber 134 for mixing with the fuel delivered through the orifice 136.

During engine idling operation, the ball valve 120 closes the passage 112 in the fitting 110, the valve 120 preventing the back bleeding of air from the mixing passage through the main orifice 108 into the engine idling fuel system so as not to impair the delivery of fuel for engine idling purposes. When the throttle valve 30 is partially opened from engine idling position, fuel may flow from the supplemental chamber 134 through both orifices 136 and 137 and, as engine speed increases and the throttle is further opened, substantially all fuel delivered into the mixing passage is through the main orifice 108.

The arrangement includes a novel method and means providing for a substantially constant amount of friction on the adjusting member or screw 42 for maintaining the engine idling position of the throttle valve 30 so that the adjustment is not impaired or disturbed by engine vibration or other forces. Referring particularly to FIGS. 1, 2, 5, 7 and 9, the projection or component 40 on the pump body or member 37 is fashioned with a portion, extension or projection 152 extending substantially normal to the projection 40 as shown in FIG. 1.

Figure 9:
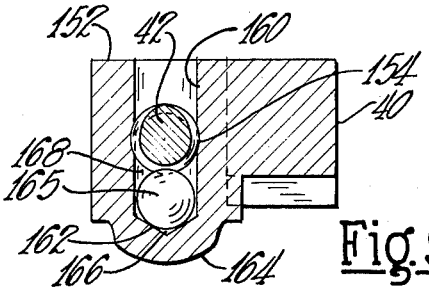
FIG. 9 is an enlarged detail sectional view taken substantially on the line 9—9 of FIG. 7.

The portion 152 is provided with a threaded bore 154, shown in FIGS. 7 and 9, into which is threaded the threaded member, component or screw 42. The threaded member or screw 42 is fashioned with a tapered or cone-shaped end 156 which, as particularly shown in FIG. 1, is engaged with an edge 157 of an arm portion 158 fashioned on the member or plate 34. As will be apparent from FIG. 1, adjustment of the screw 42 varies the region of engagement of the cone-shaped portion 156 with the arm 158, this adjustment varying or adjusting the near closed or engine idling position of the throttle valve 30 shown in FIG. 6.

Thus, by threading the screw 42 toward the arm 158 the cone-shaped portion 156 is effective to slightly open the throttle valve 30, the amount of opening depending upon the relative position of the cone-shaped portion 156 with respect to the arm 158. Rotation of screw 42 in the opposite direction is effective to adjust the throttle valve to a more nearly closed engine idling position.

Also fashioned in the projection 152 and normal to and intersecting the threaded bore 154 is a recess or bore 160, the recess or bore having a closed bottom 162 which may be cone-shaped such as is fashioned by the end of a drill in forming the recess or bore 160. The projection 152 is fashioned with a protuberance or extension 164 to accommodate the length of the bore so that the bore has a closed end. Disposed in the bore is a substantially spherically-shaped member or ball 165 fashioned or substantially rigid yet deformable resinous plastic material, such as nylon (polyamide resin), Delrin (polyoxymethylene) or the like.

The ball 165 is of slightly lesser diameter than the bore 160 so that the ball inserted in the bore will move to the bottom of the bore to the position shown in FIG. 9. The cone-shaped bottom or end 162 of the bore is dimensioned with respect to the threaded member 42 so that the periphery of the ball 165 extends slightly into the path of the threads on the screw 42 so that when the screw 42 is threaded into the bore 154, the threads of the screw engage and distant or deform the ball 165 and thereby establish substantial friction between the threads of the screw and the ball, the friction being effective to retain the screw in any position of adjustment.

The ball 165 is of a dimension to be loosely received in the bore 160. It is found that the ball 165 should be of a diameter in a range of about 0.001 of an inch and 0.008 of an inch less than the diameter of the bore 160.

While the ball 165 is fashioned of substantially rigid resinous material, it is distortable under the pressure of the threads engaging the ball and the material of the ball is of sufficient resilience to provide a substantially constant amount or level of friction betwen the ball and the threaded member 42 so that the threaded member is frictionally retained in adjusted position even though the screw 42 may be readjusted many times.

It is found that the method involving threading of the screw into its bore in interfering engagement with the ball 165 does not cut or sever the material of the ball but simply deforms or distorts the ball, the material being sufficiently resilient or having a recovery factor effective at all times to frictionally hold the screw 42 in adjusted positions.

The mounting of the ball 165 in the closed end of the bore 160 is of a character providing several regions to accommodate deformation or distortion of the resinous material of the ball. As shown in FIG. 9, a generally cone-shaped space 166 and an annular space 167 is provided between the ball 165 and the cone-shaped bottom of the bore 160. A generally annular space 168 exists adjacent the region of engagement of the ball 165 with the threads of the screw 42.

It is found that the arrangement for frictionally retaining the screw 42 in adjusted positions is not effected by engine vibrations and may be relied upon to hold the throttle valve in an adjusted engine idling position. As shown in FIG. 9, the bore 160 accommodating the ball 165 is of a diameter less than the exterior diameter of the threads of the screw 42 to provide a compact construction. As a typical example, where the threads of the screw 42 are of an exterior diameter of about ⅛ of an inch, the ball 165 may be of a diameter of about ninety thousandths of an inch or more.

The amount of the ball extending into the path of the threads of the threaded member 42 may be varied depending upon the amount of friction desired between the threads of the screw and the ball and the diameter of the threaded member. In utilizing a screw 42 having threads of an exterior diameter of approximately ⅛ of an inch, a portion of the ball should project into the path of the threads a radial distance in a range of 0.005 of an inch to 0.035 of an inch. It is to be understood that with screws of larger diameters, the ball may project into the path of the threads a radial distance greater than 0.035 of an inch.

It is found by tests that the threaded member or screw 42 may be re-adjusted more than 500 times with no appreciable variation in the amount of friction holding the threaded member or screw in adjusted positions.

In the arrangement shown in FIGS. 7 and 9, a bore 160 of about 0.093 inches in diameter, accommodating a ball 165 of a slightly lesser diameter is satisfactory for use with a threaded member or screw wherein the exterior diameter of the threads is about ⅛ inch. While the threaded member 42 has been illustrated as provided with a head 43 having a kerf to accommodate a manipulating tool, it is to be understood that the head may be omitted and the member 42 threaded throughout its length and a kerf provided in its end region.

Figure 10:
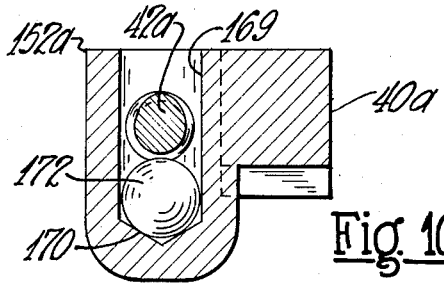
FIG. 10 is a detail sectional view similar to FIG. 9 illustrating a modified form of the invention.

It is found that the ball for providing friction on a threaded member may be of a larger diameter than that of the threaded member, if desired, and an arrangement of this character is illustrated in FIG. 10. In this form the projection **40*a* is fashioned with a portion 152*a*, the latter having a threaded bore accommodating the screw of member 42*a*. The portion 152*a* is provided with a bore 169 intersecting the threaded bore accommodating the screw 42*a*, the axis of the bore 169** being normal to the axis of the threaded bore.

The bore 169 has a bottom or end region 170 preferably of conical shape, such as the shape provided by the tapered end of a drill employed for fashioning the bore 169. The diameter of the bore 169 is such as to loosely or slidably receive a substantially spherically-shaped member or ball 172 of slightly lesser diameter than the diameter of the bore 169. The bottom region 170 of the bore 169 is dimensioned so that the upper region of the ball 172 extends into the path of the threads on the screw **42*a* so that when the screw 42*a* is threaded into its bore, the threads engage and distort or deform the ball 172 establishing friction between the threads of the screw and the ball 172.**

The ball 172 may be fashioned of nylon, Delrin or other suitable substantially regid yet distortable resin or plastic material adaptable to maintain a substantially constant amount of friction between the threads of the screw **42*a* and the ball 172. The resinous material of the ball is not cut or severed when the threads of the screw 42*a*** are engaged with the ball but is simply distorted.

The arrangement shown in FIG. 10 employing a ball 172 of larger diameter renders the tolerances of machining the bore less critical. The ball 172 is of a dimension such that the ball extends into the path of threads a distance of from about 0.015 to 0.035 depending upon the amount of friction desired between the ball and the threads of the screw. It is to be understood that the bottom or closed end of the bore may be other than conical shape, such as a flat or planar surface, as long as the configuration provides space to accommodate deformation or distortion of the ball 172.

Figure 11:
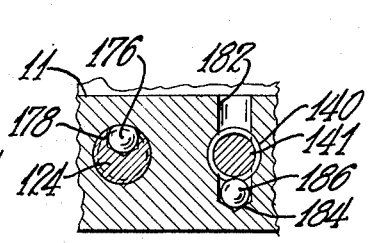
FIG. 11 is a detail sectional view taken substantially on the line 11—11 of FIG. 8.
Figure 12:
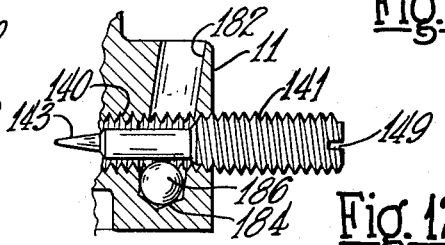
FIG. 12 is an enlarged detail sectional view illustrating the mounting of the engine idling fuel adjusting member in a retracted position.
Figure 13:
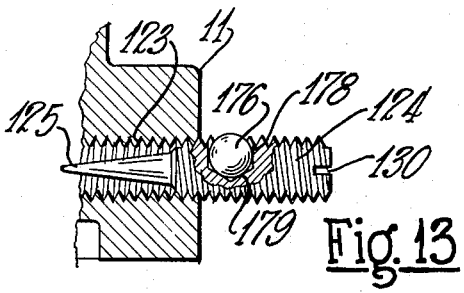
FIG. 13 is an enlarged detail sectional view illustrating the mounting of the main fuel adjusting member in a retracted position.

The method and means of the invention may be utilized in providing a substantially constant amount of friction for maintaining the fuel adjusting valves or components of the carburetor in adjusted positions. Referring particularly to FIGS. 8, 11 and 13, the valve body 124, fashioned with a needle valve portion 125, is adjustable for regulating fuel flow from the fuel chamber 65 through the restricted passage 127 and through the passages or channels in the fitting 110 for delivery through the main orifice 108 into the mixing passage for normal and high speed engine operation.

An enlarged view of the valve body member 124 and its mounting means is illustrated in FIG. 13. The ball 176 of resinous material for setting up friction is disposed in a bore 178 in the valve body, member or component, the axis of the bore 178 being normal to the longitudinal axis of the valve body. The bottom or closed end 179 is preferably of conical shape, this configuration resulting from the shape of the end of the drill utilized in forming the bore 178. FIG. 13 illustrates the relative position of the ball 176 in the bore 178 with a portion of the ball extending slightly above the threads on the member 124.

When the member, valve body of component 124 is threaded into the threaded bore 123 in the carburetor body or component 11, the ball is deformed or distorted as it is engaged by the threads 123, the distorted material of the ball being forced into the spaces provided by the cone-shaped bottom of the bore 178. The ball may extend above the threads a radial distance in a range of about 0.005 of an inch to 0.035 of an inch, the extend of the projection of the ball above the threads being dependent in a measure upon the diameter of the threads of member 124 and the degree or amount of friction desired.

When the ball or spherically-shaped body 176 is engaged with the threads 123, the ball is not severed or cut but is simply deformed or distorted, a condition setting up friction between the ball 176 and the threads 123 effective to frictionally hold the valve body or member 124 and its needle valve portion 125 in any position of adjustment. It is found that irrespective of the number of repeated adjustments of the valve body 124, the amount of friction remains substantially constant and the adjustment of the fuel regulating needle valve 125 is not disturbed or affected by engine vibration or other forces. The ball 176 is of slightly lesser diameter than the diameter of the bore 178 so that the ball is slidably or loosely received in the bore.

The invention may be utilized to hold the valve body or member 141 and the needle valve portion 143 in adjusted positions for regulating flow of fuel from the chamber 65 into the supplemental chamber 134 for delivery through the engine idling and low speed orifices 136 and 137 respectfully. As shown in FIGS. 7, 8, 11 and 12, the carburetor body 11 is provided with a bore 182 which intersects and is substantially normal to the threaded bore 140, the bore 182 extending across the bore 140 and is fashioned with a closed bottom or closed end 184 of cone-shaped configuration.

A substantially spherical member or ball 186 of distortable or deformable resinous material is disposed in the bottom of the bore 182, the ball 186 being of slightly less diameter than the diameter of the bore 182 is loosely received in the bore. When the threaded member or valve body 141 is threaded into the theads 140, the ball 186, having a portion extending into the path of the threads on the member 141, is distorted, setting up friction for holding the valve body 141 and its needle valve 143 in adjusted position.

As the substantially rigid ball 186 is distorted, an amount of friction is to be set up effective to frictionally hold the valve body in adjusted positions, the holding force being sufficient to prevent engine vibrations affecting the adjustment. The ball 186 is of a dimension whereby the same extends into the path of the threads 140, a radial distance of from 0.005 of an inch to 0.035 of an inch dependent upon the amount of friction desired and the diameter of the threaded member 141.

From the foregoing it will be apparent that the use of a nylon ball or a ball of other suitable resinous material may be employed in association with the engine idling adjustment screw 42, the main or high speed fuel adjusting valve 125 and the fuel adjusting valve 143 for engine idling and low speed purposes, the screw 42 and the fuel adjusting valves may be frictionally retained or held in adjusted positions without the use of springs, and that the use of a ball or resinous material enables repeated adjustments of these components without appreciably or impairing the frictional force holding these components in adjusted positions.

FIGS. 14 through 23 illustrate the invention embodied in a modified form of diaphragm carburetor and fuel pump construction 190 embodying the invention. The carburetor illustrated in these figures embodies forms of the invention for the engine idling adjustment screw or component for establishing friction to hold the choke valve or component of the carburetor in adjusted positions, and for holding the fuel adjusting needle valves or components in adjusted positions.

Figure 18:
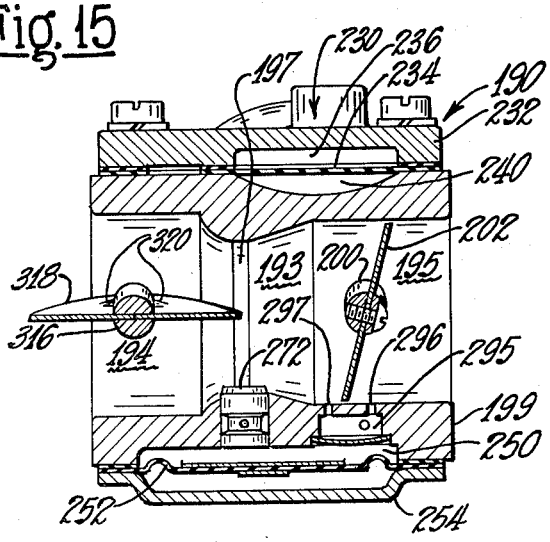
FIG. 18 is a longitudinal sectional view taken substantially on the line 18—18 of FIG. 16.

The carburetor includes a body, member or component 191 of die cast metal such as an allow of aluminum or zinc or other suitable metal. The carburetor body 191 is formed with two through cylindrical passages 192 accommodating mounting bolts (not shown) for securing the body to an intake manifold or to the crankcase of a two cycle engine. The carburetor body 191, as shown in FIG. 18, is fashioned with a mixing passage 193 having an air inlet region 194 and a mixture outlet region 195, the mixing passage including a Venturi configuration 197. The mixture outlet end of the carburetor has a mounting surface 199 for mounting on an intake manifold or on the crankcase of a two cycle engine.

Journaled in aligned bores in the body 191 and extending across the mixing passage is a throttle shaft 200 equipped with a throttle valve 202 disposed in the mixing passage, the shaft being rotatable to vary the position of the throttle valve for controlling mixture flow to the engine. A portion of the throttle shaft 200 exteriorly of the carburetor body is equipped with a member or plate 204 fixedly secured on the throttle shaft by swagging the end region of the shaft as at 205 in FIGS. 14, 15 and 16. The plate is provided with openings 206 and a throttle operating rod 207 has an end region engageable in a selected opening for manipulating the throttle shaft 200.

The body 191 is fashioned with an integral L-shaped projection 208, one portion 209 extending laterally from one side of the carburetor body 191 and a second portion 210 extending substantially parallel with the adjacent side wall of the body and normal to the direction of the portion 209. The member or plate 204 has a portion 212 extending toward the carburetor body which is integrally formed with an arm or portion 214 extending substantially normal to the portion 212, as shown in FIGS. 14 through 17.

A coil spring 216 surrounds the portion of the shaft 200 between the side wall of the body 191 and the plates 204, one end 217 of the spring being hooked over the portion 212 of the plate 204 and the other end (not shown) being engaged in a recess in the side wall of the body. The coil spring 216 normally biases the plate 204 for rotation in a clockwise direction, as viewed in FIG. 15, urging the throttle valve 202 toward near closed or engine idling position, as shown in FIG. 18.

The portion 210 of the L-shaped projection 208 is provided with a threaded bore accommodating a threaded member or throttle adjusting screw 220, the screw having a head 221 fashioned with a kerf for accommodating a tool for adjusting the screw. The opposite end of the threaded member 220 is tapered or cone-shaped as indicated at 222. The cone configuration is adapted to be engaged by the arm 214 on the plate 204. BY manipulating the threaded member or screw 220, the cone-shaped configuration 222 varies the position of the arm 214, the plate 204 and the throttle valve 202 so as to vary or adjust the extent of the opening of the throttle valve in engine idling position.

The portion 210 is fashioned with a bore 224 disposed normal to and intersecting the threaded bore accommodating the threaded member 220, the closed bottom of the bore being indicated at 225 which may be conical as fashioned by the coneshaped tip of a drill used in forming the bore. Disposed in the bore 224 is a substantially spherically-shaped member or ball 227 fashioned of substantially rigid, yet deformable, resinous plastic material, such as nylon, Delrin or the like.

Figure 14:
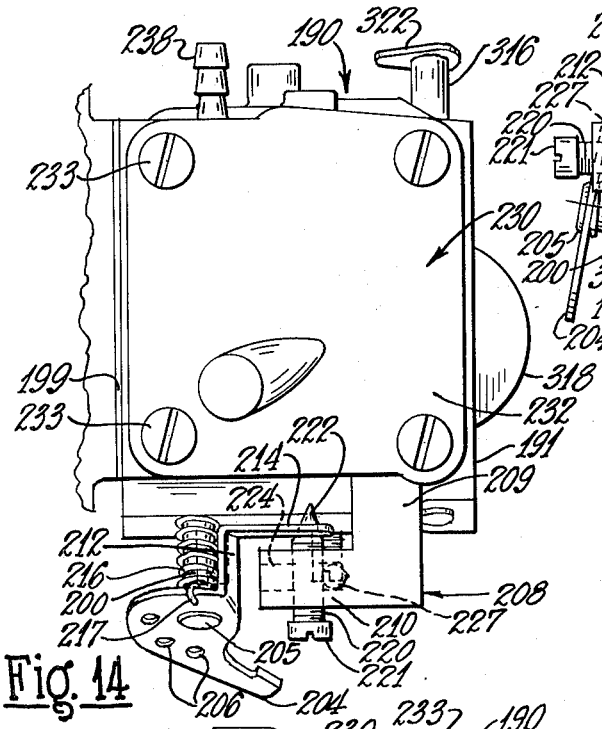
FIG. 14 is a top plan view of another form of combined fuel pump and charge forming apparatus embodying the invention.
Figure 15:
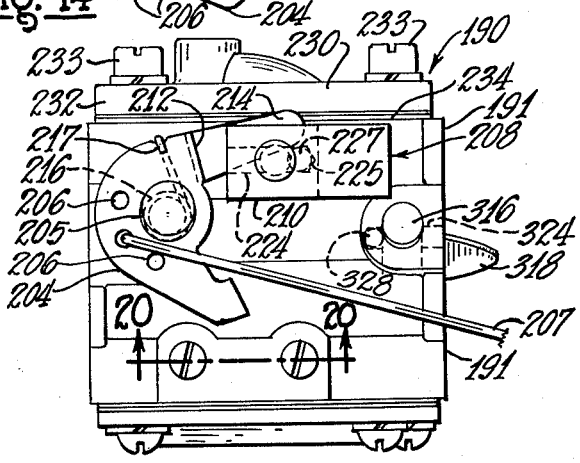
FIG. 15 is a view of one side of the construction shown in FIG. 14.

The ball 227 is of slightly lesser diameter than the bore so that the ball inserted in the bore will move to the bottom of the bore to the position shown in FIGS. 14 and 15. The cone-shaped bottom or closed end of the bore is dimensioned with respect to the threaded member 220 whereby the ball extends slightly into the path of the threads on the threaded member or screw 220 so that when the screw is threaded into the bore, the threads of the screw engage and distort or deform the ball 227 and thereby establish friction effective to retain the screw 220 in any position of adjustment.

While the ball 227 is fashioned of substantially rigid resinous material, it is distortable or deformable under the pressure of the threads engaging the ball and is of sufficient resilience to provide and maintain a substantially constant amount or level of friction so that the threaded member is frictionally retained in adjusted position even though the threaded member 220 may be readjusted many times. It is found that the threading of the screw in engagement with the ball 227 does not cut or sever the material of the ball but simply deforms or distorts it.

It is found that the amount or portion of the ball extending into the path of the threads of the threaded member 220 may be varied depending upon the amount of friction desired between the threads of the screw and the ball. In utilizing a screw 220 having threads of an exterior diameter of approximately oneeighth of an inch, a portion of the ball should project into the path of the threads a radial distance in a range of 0.005 of an inch to 0.035 of an inch.

Figure 19:
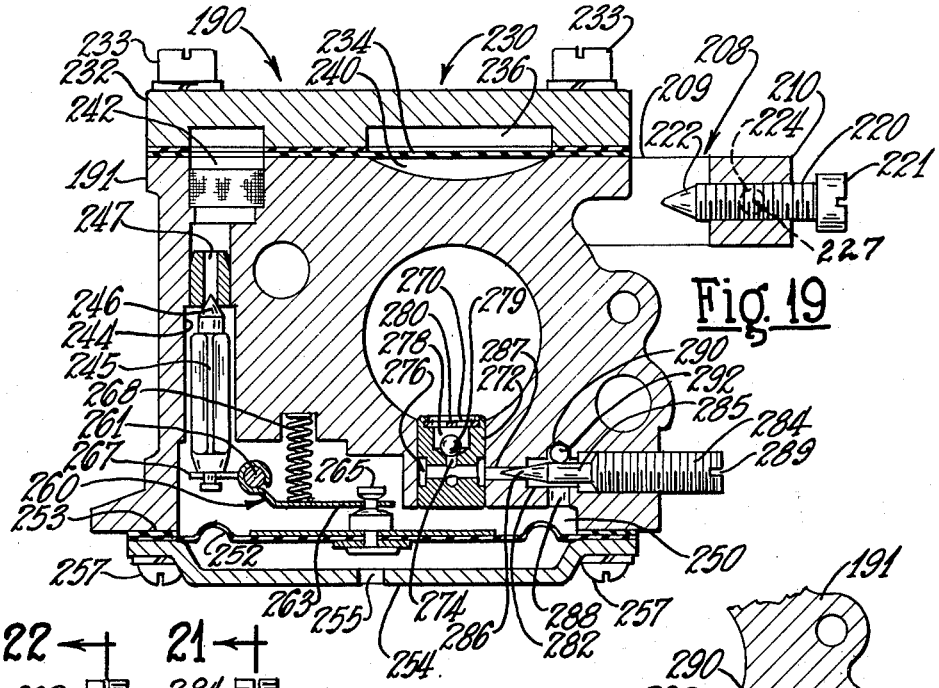
FIG. 19 is a transverse sectional view taken substantially on the line 19—19 of FIG. 17.
Figure 20:
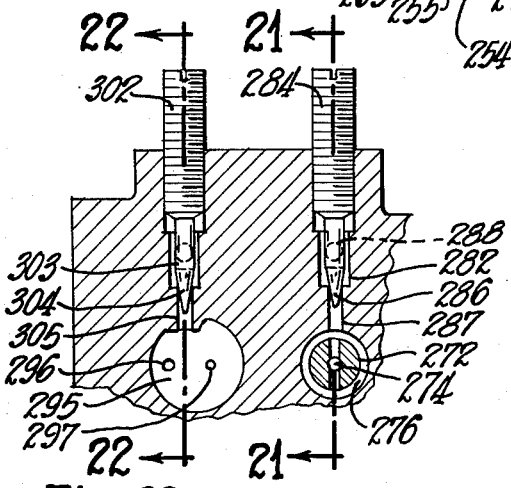
FIG. 20 is a fragmentary sectional view taken substantially on the line 20—20 of FIG. 15.

In the arrangement shown in FIG. 19, a bore 224 of about 0.093 inches in diameter, accommodating a ball 227 of a slightly lesser diameter, is satisfactory for use with the threaded member or screw 220. While the threaded member 220 is fashioned with a head 221, it is to be understood that the head may be omitted and the member 220 threaded throughout its length with a kerf fashioned in the end of the member.

The arrangement illustrated in FIGS. 14 through 18 includes a fuel pump construction 230 having a pump body or member 232 and a pumping diaphragm 234 secured to the carburetor body 191 by screws 233. A pulse or pumping chamber 236 in the body 232 is connected by a pulse channel (not shown) connected with the crankcase of a two cycle engine whereby the varying fluid pressure in the crankcase vibrates the pumping diaphragm 234 to pump fuel from a supply to the carburetor.

A nipple 238 mounted in the carburetor body is connected by a tube (not shown) with a fuel tank. The pumping diaphragm 234 is fashioned with flap valves (not shown) cooperating with ports in communication with a fuel chamber 240 whereby liquid fuel is pumped by the diaphram 234 from the fuel tank to the chamber 240 and from the chamber 240 to a fuel inlet passage 242 in the carburetor body.

As shown in FIG. 19, a bore 244 in the carburetor body 191 slidably accommodates a fuel inlet valve body 245, the valve body 245 being of polygonal cross section and fashioned at one end with a needle valve portion 246 cooperating with a fuel inlet port 247 which opens into the fuel passage 242. The carburetor body 191 is fashioned with a circular recess providing a fuel chamber 250, a flexible member or diaphragm 252 extending across the recess and forming one wall of the fuel chamber 250.

An annular gasket 253 is disposed between the periphery of the diaphragm 252 and a portion of the carburetor body defining the fuel chamber 250. A cover member 254 disposed beneath the diaphragm 252, as shown in FIGS. 18 and 19, has a depressed central region to accommodate flexing of the diaphragm, the cover 254 having a vent opening 255. Screws 257 secure the cover member 254, the diaphragm 252 and the gasket 253 in assembly with the body.

Figure 17:
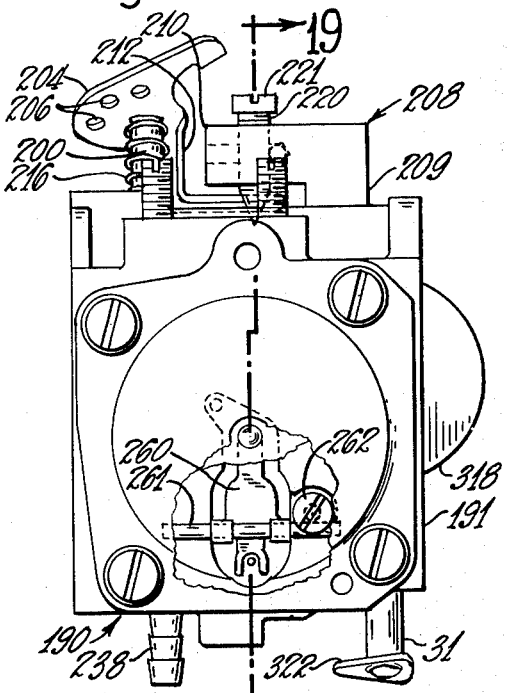
FIG. 17 is a bottom plan view of the construction shown in FIG. 15 with certain parts broken away.

A lever 260 disposed in the fuel chamber 250 is fulcrumed intermediate its ends on a pivot pin 261, the pin being secured to the body 191 by a screw 262 shown in FIG. 17. The long arm 263 of the lever is adapted for engagement with a buttonlike member 265 secured to the central region of the diaphragm 252 by reinforcing discs disposed on opposite sides of the diaphragm. The short arm 267 of the lever has operative engagement with the inlet valve body 245 as shown in FIG. 19.

An expansive coil spring 268, engaging the long arm 263 of the lever, normally biases the lever for pivotal movement in a clockwise direction (as viewed in FIG. 19) about the fulcrum pin 261 urging the needle valve 246 to close the fuel inlet port 247. Flexing movements of the metering diaphragm 252 under the influence of aspiration in the mixing passage 193 actuates the valve 246 to control fuel flow through the port 247 into the fuel chamber 250.

The carburetor illustrated in FIGS. 14 through 19 includes a main or primary fuel delivery system and a secondary or engine idling and low speed fuel delivery system. The main or primary fuel delivery system is inclusive of a main orifice 270 provided by a fitting 272 disposed in a bore in the carburetor body as illustrated in FIG. 19. The fitting 272, like the fitting 110, is fashioned with a central fuel passage or well 274 and cross channels in communication with a peripheral channel 276.

The fitting is fashioned with a counterbore 278 accommodating a ball valve 279 retained in the counterbore by a grid 280, the interstices in the grid providing the main fuel dilivery orifice 270. When the engine idling fuel delivery system is in operation, the ball valve 279 prevents back bleeding of air through the main orifice.

The carburetor body 191 is fashioned with a bore 282 having a threaded portion which receives a threaded member or valve body 284, the body having a cylindrically-shaped tenon 285 terminating in a needle valve portion 286 which extends into a restricted fuel passage 287, the latter opening into the peripheral channel 276 in the fitting 272. The bore 282 receives fuel for normal and high speed engine operation from the fuel chamber 250 through a passage or bore 288, the fuel flowing past the needle valve 286 through passage 287, the peripheral channel 276 and the transverse passages in the fitting 272 and through the well 274 to the main orifice 270. A slot or kerf 289 in the end of the valve body 284 accommodates a tool for adjusting the body.

Figure 21:
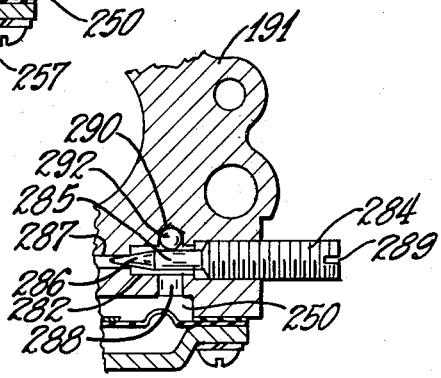
FIG. 21 is an enlarged fragmentary sectional view taken substantially on the line 21—21 of FIG. 20.
Figure 22:
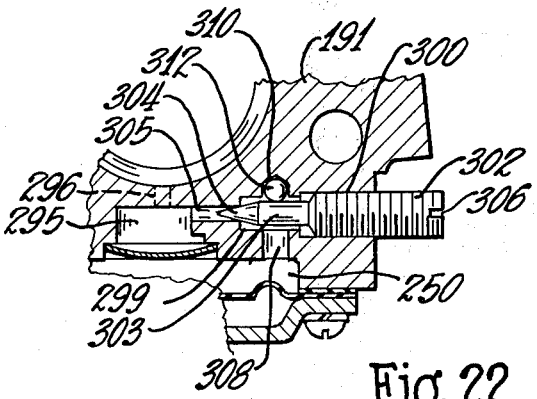
FIG 22 is an enlarged fragmentary sectional view taken substantially on the line 22—22 of FIG. 20.

A form of the friction holding device of the invention is associated with the tenon portion 285 of the main fuel adjusting needle valve 286 for establishing and maintaining a substantially constant amount of friction on the valve body 284 for frictionally holding the needle valve 286 in adjusted positions. As shown in FIGS. 19 and 21, the passage or bore 288 intersects the bore 282 and extends upwardly above the tenon portion 285 of the valve body 284, the axis of the bore 288 being normal to the longitudinal axis of the bore 282.

The bottom or closed end 290 of the bore 288 is of conical shape formed by the tapered or cone-shaped end of the conventional drill utilized in forming the bore 288. Disposed in the bottom of the bore 288 is a substantially rigid, yet deformable, spherical member or ball 292 of resinous material, such as nylon, Delrin or the like. The ball is of a diameter to be loosely or slidably received in the bore 288 and to project a slight distance into the path of longitudinal adjustment of the tenon portion 285 so that the ball exerts lateral pressure on the tenon 285 establishing friction between the ball and the tenon 285 and at the threads in an amount effective to maintain the valve body 284 in all positions of adjustment.

In this arrangement, the deformable ball 292 extends into the path of adjustment of the tenon portion 285 a radial distance in a range of about 0.002 of an inch and 0.010 of an inch to establish lateral pressure of the ball on the tenon 285. The mounting of the ball 292 in the closed end of the bore 288 provides regions at the cone-shaped space at the bottom of the bore and an annular space adjacent the region of contact of the ball with the cone-shape of the bore accommodating deformation or distortion of the resinous material of the ball 292 as hereinbefore described in connection with the mounting of the ball 165.

The tenon portion 285 may be distorted slightly laterally under the pressure of the ball whereby the needle valve portion 286 may be moved slightly out of or to one side of its normal axial position, but such condition does not impair fuel flow through the restricted passage 287 as the fuel will flow past the needle valve at the region of increased clearance at one side of the needle valve. The constant pressure of the ball 292 on the tenon portion 285 maintains a substantially constant amount of friction in the interengaged threads. The valve body 284 may be readjusted many hundreds of times and held in adjusted position by friction which is always substantially constant in amount.

The method and arrangement of the invention may be utilized in providing friction for holding in adjusted positions a fuel adjusting means utilized for regulating flow of fuel in a secondary fuel delivery system into the mixing passage for engine idling and low speed operation. As particularly shown in FIGS. 18 and 22, the carburetor body 191 is fashioned with a supplemental chamber 295, an engine idling orifice 296 and a low speed orifice 297 in communication with the supplemental chamber 295 opening into the mixing passage. The body 191 is provided with a bore 299 having a threaded portion 300 accommodating the threaded portion of a member or valve body 302.

The valve body 302 has a cylindrically-shaped tenon portion 303 terminating in a needle valve portion 304 extending into and cooperating with a restricted passage 305, the latter opening into the supplemental chamber 295. The outer end of the valve body 302 is fashioned with a slot or kerf 306 to accommodate a tool for adjusting the valve body 302 and the needle valve portion 304. Extending transversely of the axis of the bore 299 is a bore or passage 308 intersecting the bore 299 and having a cone-shaped closed bottom or end 310.

The bore 308 provides a passage for fuel flow from the fuel chamber 250 into the bore 299. The region of the bore 308 above the tenon portion 303 accommodates a substantially spherically-shaped member or ball 312 of resinous material, such as nylon, Delrin or the like. The ball 312 is of a diameter slightly less than the diameter of the bore 308 so that the ball is loosely received in the bore.

The cone-shaped bottom or closed end of the bore 308 is dimensioned with respect to the surface of the tenon portion 303 whereby the ball 312 extends slightly into the path of the tenon 303 so that when the valve body 302 is threaded into the threaded bore 300, the tenon 303 is engaged by the ball and the material of the ball distorted to thereby establish substantial friction between the ball and the tenon 303 and between the threads of the valve body 302 and the threads in the threaded bore 300. The friction thus established is effective to retain the valve body 302 and its needle portion 304 in any position of adjustment.

In this arrangement the deformable ball 312 extends into the path of adjustment of the tenon portion 303 a radial distance in a range of about 0.002 and 0.010 of an inch to establish lateral pressure of the ball on the tenon 303. The mounting of the ball 312 in the cone-shaped end of the bore 308 provides a cone-shaped space at the bottom of the bore and an annular space adjacent the region of contact of the ball with the cone configuration of the bore accommodating deformation or distortion of the resinous material of the ball.

While the tenon portion 303 may be distorted slightly laterally under the pressure of the ball 312 and thereby moved slightly out of or to one side of its normal axial position, such condition does not impair fuel flow through the restricted passage 303 as the fuel flows past the needle valve at the region of increased clearance at one side of the needle valve.

The pressure of the ball 312 on tenon portion 303 establishes and maintains a substantially constant amount of friction between the ball and the tenon portion and between the threads of the valve body and the threaded bore 300 for retaining the valve body 302 and its needle valve portion 304 in adjusted positions. Through the provision of a substantially constant amount of friction, the valve body 302 may be readjusted many times without appreciable variation in the amount of friction.

Figure 16:
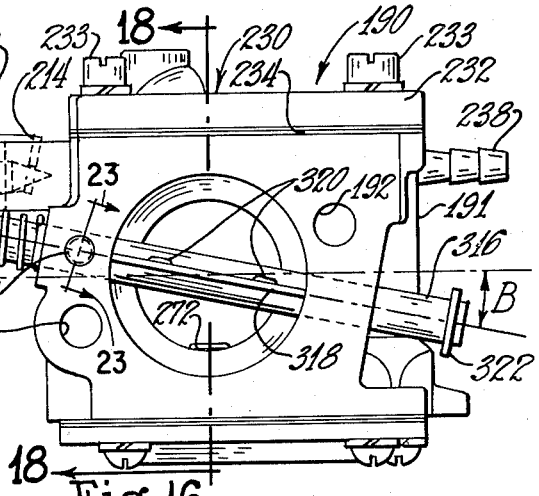
FIG. 16 is a view of the air inlet end of the carburetor shown in FIG. 15.
Figure 23:
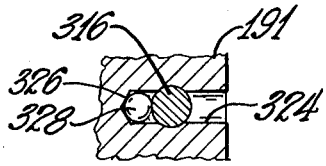
FIG. 23 is a fragmentary detail sectional view taken substantially on the line 23—23 of FIG. 16.

The method and arrangement of the invention are adaptable for frictionally retaining a relatively-movable smooth-surfaced shaft or member in adjusted positions. FIGS. 15, 16 and 23 illustrate an arrangement of the invention for holding a choke valve shaft or component 316 in adjusted positions. The choke valve shaft 316 is journally mounted in aligned bores provided in the carburetor body or component 191, the shaft or member 316 extending diametrically across the air entrance region 194 of the mixing passage as shown in FIGS. 16 and 18.

The region of the shaft 316 at the mixing passage is provided with a longitudinal slot in which is received a circular choke valve 318, the choke valve being held against dislodgement relative to the shaft by means of projections 320, shown in FIG. 18, at each side of the shaft 316, the projections 320 being fashioned by partially severing and indenting portions of the valve disc 318. An extending portion of the shaft 316 is equipped with an arm 322 as shown in FIGS. 14 and 16 for manipulating the choke shaft for opening and closing the choke valve 318.

The carburetor body 191 is fashioned with a bore 324 extending transversely of the longitudinal axis of the choke shaft 316 and extending across or intersecting one of the bores in which the shaft 316 is journally mounted as shown in FIGS. 16 and 23. The bore 324 is fashioned with a closed bottom or closed end 326 of cone shape as formed by the coneshaped end of a drill. A substantially spherically-shaped member or ball 328 or distortable or deformable resinous material is disposed in the bottom of the bore 324, the ball 328 being of slightly less diameter than the diameter of the bore 324 is loosely received in the bore.

The ball 328 is of a dimension whereby the same extends into the normal path of the shaft 316, a radial distance of from 0.002 of an inch to 0.010 of an inch depending upon the amount of friction desired and the diameter of the shaft 316. The ball or spherically-shaped member 328 may be fashioned of nylon, Delrin or other suitable resinous material, the material being substantially rigid, yet distortable or deformable under pressure.

In assembling the choke shaft in its journal bores, the ball 328 is dropped into the bore 324, occupying the position shown in FIG. 23. The choke shaft 316 is then inserted in the journal bores and forced past the resinous ball 328, deforming the ball as herein described in connection with other forms of the invention. The material of the ball 328, while substantially rigid, is sufficiently resilient to be deformed or distorted by the insertion of the choke shaft 316 in its journal bores.

The deformed or distorted ball 328 exerts substantially constant pressure against the choke shaft 316 and hence sets up a substantially constant amount of friction which is effective to frictionally hold the choke shaft in any position of adjustment. After the choke shaft is fully inserted in its journal bores, the choke valve or disc member 318 is inserted in the slot in the shaft 316 at the region of the mixing passage and the choke valve or disc 318 indented by a suitable tool to form the projections 320 at one side of the disc, the other projections 320 having been formed in the disc prior to its insertion in the slot in the shaft 316.

The operation of the carburetor shown in FIGS. 14 through 23 is similar to the operation of the carburetor shown in FIGS. 1 through 9 and 11 through 13. In initiating operation of the engine, the operator closes the air inlet region 194 of the mixing passage by moving the shaft 316 to position the choke valve 318 substantially crosswise of the air entrance region. The choke valve is held in such position under the friction provided by the distortion of the ball 328.

The engine is then cranked by the operator with the throttle valve 202 in partial or full open position. Engine aspiration set up in the mixing passage, by initial rotation of the engine by manual cranking, is effective to aspirate fuel from the fuel chamber 250 through the passage 288, bore 282, past the needle valve 286 and passage 287 and through the channels and passages in the fitting 272 and discharged through the main orifice 270, thus starting the engine.

Upon starting of the engine, the operator manually rotates the choke shaft 316 by manipulating the arm 322 moving the choke valve or valve member 318 to full open position as shown in FIG. 18. The substantially constant friction provided by the deformation of the ball 328 holds the choke valve in open position. The engine aspiration of fuel through the main orifice into the mixing passage sets up reduced pressure in the fuel chamber 250 flexing the metering diaphragm 252 upwardly and, through the medium of the lever 260, moves the needle valve 246 to open the inlet port 247.

The fuel under low pressure from the fuel pump 230 flows past the inlet valve 246 into the fuel chamber 250 substantially at the rate at which fuel is aspirated into the mixing passage. The rate of fuel delivery to the main orifice 270 is regulated or controlled by adjustment of the valve body 284 and its needle valve 286. The deformation of the ball 293 exerts substantially constant pressure against the tenon portion 285 of the valve body 284, establishing substantially constant friction effective to hold the needle valve 286 in any position of adjustment.

The engine idling position of the throttle valve, that is, a slight opening of the throttle valve is attained by adjusting the threaded member or screw 220 shown in FIGS. 14 and 16. The ball 227 engaged by the threads of the screw 220 provides friction effective to maintain the throttle adjusting screw 220 in any position of adjustment.

The valve body 302 is adjusted whereby the needle valve portion 304 regulates the fuel flow to the engine idling and low speed orifices 296 and 297, the friction provided by the ball 312 in engagement with the tenon portion 303 providing substantially constant friction effective to hold the needle valve 304 in any position of adjustment. When the throttle valve 202 is moved to near closed or engine idling position, as shown in FIG. 18, fuel for engine idling operation flows from the fuel chamber 250 through the bore or passage 308 into the bore 299, past the needle valve 304 into the supplemental chamber 295 thence through the orifice 296.

During engine idling operation, the check valve or ball 279 in the fitting 272 closes the passage 274 preventing back bleeding of air from the mixing passage through the main orifice into the engine idling fuel system so as not to impair the delivery of fuel for engine idling purpose. When the throttle valve 202 is partially opened from engine idling position, fuel may flow from the supplemental chamber 295 through the orifice 297 into the mixing passage for low speed engine operation. As the throttle is further opened, engine speed increases and fuel is then delivered through the main orifice 270.

Figure 24:
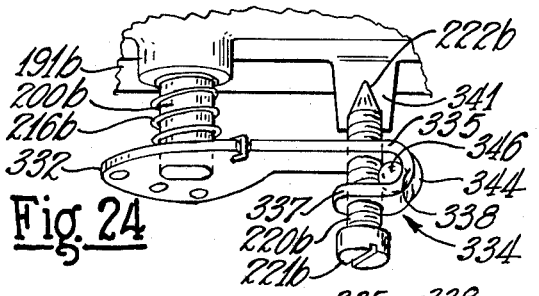
FIG. 24 is a fragmentary top plan view illustrating a modified form of throttle adjusting means embodying the invention.
Figure 25:
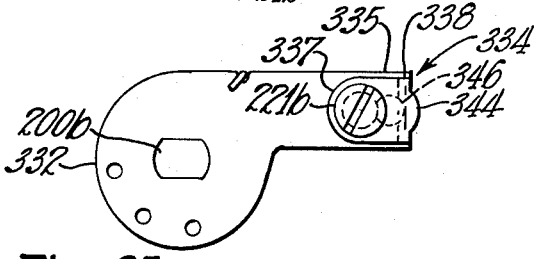
FIG. 25 is a front view of the construction shown in FIG. 24.
Figure 26:
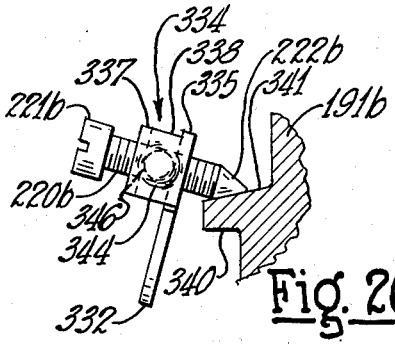
FIG. 26 is a side view of the construction shown in FIG. 24.

FIGS. 24 through 26 illustrates a modified arrangement embodying the invention for adjusting the engine idling position of the throttle valve. Journaled in bores in the carburetor body 191*b* is a throttle shaft 200*b* which mounts a throttle valve, such as the throttle valve 202, shown in FIG. 18. Secured to an end of the throttle shaft 200*b* exteriorly of the carburetor body is a member, plate or component 322 adapted to rotate with the shaft. A coil spring 216*b* normally biases the member or plate 332 in a clockwise direction, as viewed in FIG. 5, urging the throttle valve toward near closed or engine idling position.

The member 332 has a projection 334 provided by an extension or portion 335 integral with the member 332, a portion of the metal of the extension being folded in a reverse direction to form a portion 337, the extension and portion 337 being integrally joined by a connecting bridge region 338 providing the projection 334 of U-shaped configuration as shown in FIG. 24. The extension or portion 335 and the portion 337 are in substantial parallelism and are provided with aligned threaded bores receiving a threaded member, screw or component 220*b* having a head 221*b*.

The opposite end of the threaded member or screw 220*b* is tapered or cone-shaped as indicated at 222*b*. The body 191*b* is fashioned with a projection 340 having a surface 341 adapted to be engaged by the cone-shaped portion 222*b*, as shown in FIG. 26. By manipulating the threaded member or screw 220*b*, the cone-shaped configuration 222*b*, engaging the surface 341, varies the position of the member 332 and the throttle valve to thereby vary or adjust the extent of opening of the throttle valve for engine idling position.

The metal 338 at the interior of the bight portion of the U-shaped projection 334 is shaped or indented to form a recess or space, the indenting operation forcing the metal outwardly as at 344, the recess of space being closed by the raised metal 344. Disposed in the recess in the bight portion of the projection 334 is a spherically-shaped member or ball 346 fashioned of substantially rigid, yet deformable, resinous plastic material, such as nylon, Delrin or the like. The ball 346 is loosely received in the space or recess formed in the metal 338 of the bight portion of the projection 334.

The ball 346 is dimensioned so that when it is seated in the recess it normally extends slightly into the path of the threads on the threaded member or screw 220 whereby a portion of the ball presents interference to the threads of the screw. When the screw is threaded into the aligned threaded bores in the portions 335 and 337 of the member 332, the threads of the screw engage or distort or deform the material of the ball and thereby establish friction effective to retain the screw 220 in any position of adjustment.

As a substantial portion of the ball extends above the metal 338 of the bight portion, there is ample space adjacent opposite surface regions of the ball to accommodate the distortion or deformation of the material of the ball. The portion of the tool utilized for indenting the recess in the metal 338 may be of generally spherical shape or may be of tapered configuration with a rounded end portion whereby the wall region of the recess formed thereby may be of tapered shape with a rounded end, the reciprocably shaped rounded end in the bottom or closed end of the recess providing an additional space to accommodate deformation or distortion of the material of the ball.

The portion of the ball should project into the path of the threads of the screw 220*b* a radial distance in a range of 0.005 of an inch to 0.035 of an inch where the diameter of the ball 346 is about 3/32 of an inch in diameter.

While in the arrangement shown in FIGS. 24 through 26, the axis of the screw 220*b* is substantially parallel with the axis of the throttle shaft 200*b*, it is to be understood that the extension portion 335 of the member 332 may be distorted or bent to a position wherein the axis of the screw 220*b* is substantially parallel with respect to the plane of the metering diaphragm of the carburetor, such as the metering diaphragm 252 shown in FIG. 19.

Figure 27:
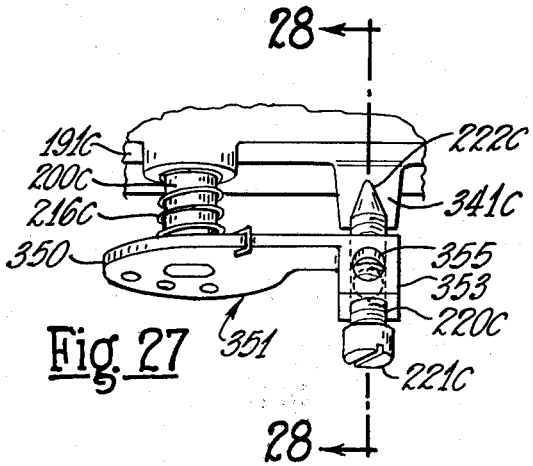
FIG. 27 is a top plan view similar to FIG. 4 illustrating another form of throttle adjusting means embodying the invention.
Figure 28:
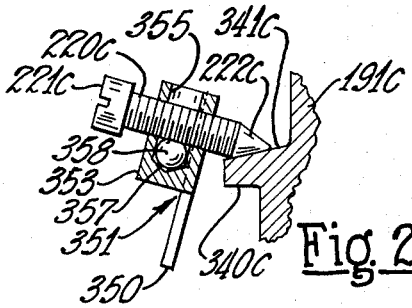
FIG. 28 is a sectional view taken substantially on the line 28—28 of FIG. 27.

FIGS. 27 and 28 illustrate a modified construction similar to the arrangement shown in FIGS. 24 through 26 and embodying the invention for adjusting the engine idling position of the throttle valve. The shaft 200*c*, journaled in bores in the carburetor body 191*c*, is equipped with a throttle valve such as the throttle valve 202 shown in FIG. 18. Secured to the end of the throttle shaft 200*c* is a planar or plate portion 350 of a member 351, the member being rotatable with the throttle shaft. A coil spring 216*c* normally biases the member 351 and the shaft 200*c* in a direction urging the throttle valve toward near closed or engine idling position.

The member 351 is formed with an enlarged portion or projection 353 having a threaded bore accommodating a threaded member or screw 220*c* having a head 221*c*. The opposite end of the threaded member or screw 220*c* is tapered or cone-shaped as at 222*c*. The body 191*c* is provided with a portion or projection 340*c* having a surface 341*c* adapted to be engaged by the cone-shaped portion of the screw 220*c*. By manipulating the threaded member or screw 220*c*, the cone-shaped configuration 222*c* engaging the surface 341*c* varies the position of the member 350 and the throttle valve to vary or adjust the extent of opening of the throttle valve for engine idling position.

Also providing in the projection 353 is a bore or recess 355, the bore 355 being normal to and intersecting the threaded bore accommodating the screw 220*c*. The bore 355 has a closed bottom or end 357 which is preferably cone-shaped such as is fashioned by the end of a drill in forming the bore. Disposed in the closed end region of the bore is a substantially spherically shaped member or ball 358 fashioned of substantially rigid, yet deformable, resinous plastic material, such as nylon, Delrin or the like.

The ball 358 is of slightly lesser diameter than the bore 355 so that the ball inserted in the bore will slide or move to the bottom of the bore to the position shown in FIG. 28. The closed bottom or end 357 of the bore is dimensioned with respect to the threaded member 220*c* so that a peripheral portion of the ball extends slightly into the path of the threads on the screw 220*c* setting up interference with the threads of the screw.

When the screw is threaded into the threaded bore in the projection 353, the threads of the screw engage and distort or deform the ball 358 and thereby establish substantial friction between the threads of the screw and the ball and between the threads of the screw and those in the bore effective to retain the screw in any position of adjustment. It is found that the ball 358 should be of a diameter in a range of about 0.001 of an inch and 0.008 of an inch less than the diameter of the bore 355.

Where the threads of the screw 220*c* are of an exterior diameter of about one-eighth of an inch, the ball 358 may be of a diameter of about 90/1000 of an inch or more. The ball should project into the path of the threads a radial distance in a range of about 0.005 of an inch to 0.035 of an inch. It is to be understood that with threaded members or screws of larger diameters, the ball may project into the path of the threads a radial distance greater than 0.035 of an inch.

It is found that the material of the ball, while being substantially rigid, has sufficient resilience to provide a substantially constant amount of or level of friction so that the threaded member 220*c* is frictionally retained in adjusted positions even though the threaded member may be readjusted many times. While the threaded member 220*c* is provided with a head 221*c*, having a kerf to accommodate a manipulating tool, it is to be understood that the head 221*c* may be omitted and the member 220*c* threaded throughout its length and a kerf proficed in its end region.

From the foregoing description it will be seen that a spherically-shaped member of substantially rigid, yet deformable, or distortable resinous material may be employed for engagement with threads of threaded members, or arranged to exert lateral pressure on relatively movable smooth-surfaced members, bodies or shafts for establishing and maintaining a substantially constant amount of amount of friction for holding threaded members, bodies or shafts in adjusted positions. The friction device of the invention enables repeated adjustments to be made with no appreciable variation in the frictional force for holding relatively movable members or bodies in adjusted positions. The friction device eliminates the use of springs for establishing friction forces or pressures for holding members in adjusted positions, the friction device being unaffected by engine vibrations or other extraneous forces.

The invention enables the use of fuel adjusting valve means of comparatively short lengths providing for a more compact construction. The invention also enables the use of a throttle position adjusting screw and fuel adjusting valve members accessible from one side of a carburetor thereby promoting ease of the several adjustments.

It is apparent that, within the scope of the invention, modifications and different arrangements may be made other than as herein disclosed, and the present disclosure is illustrative merely, the invention comprehending all variations thereof.

I claim:

1. The method of retaining a relatively movable first member in adjusted positions with respect to a second member of a charge forming apparatus including forming a space in one of the members adjacent the other of the members, inserting in the space a substantially spherically-shaped deformable body loosely disposed in the space and in a position to effect interference with the other of said members, and moving the first member relative to the second member to engage and deform the spherically-shaped body establishing substantial friction effective to retain the relatively movable member in adjusted positions.

2. The method of retaining a relatively movable control component in adjusted positions with respect to a second component of a charge forming apparatus including providing a space in one of the components adjacent the other component, inserting in the space a substantially spherically-shaped body of deformable material loosely disposed in the space and of a dimension to effect interference with the other of the components, and moving the movable component with respect to the second component to engage and deform the body providing lateral pressure between the components establishing friction effective to hold the control component in adjusted positions.

3. The method of frictionally retaining a relatively movable control component in adjusted positions with respect to a second component of a charge forming apparatus including forming a bore in one of said components normal to the axis of movement of the relatively movable control component, inserting in the bore a substantially spherically-shaped deformable resinous body of a diameter less than the diameter of the bore and to a depth to effect normal interference with the other of the components, and moving the control component with respect to the second component to engage and deform the resinous body establishing friction effective to hold the control component in adjusted positions.

4. The method of frictionally retaining in adjusted positions a relatively movable first component having a smooth surface portion with respect to a second component in a charge forming apparatus including forming a first bore in the second component accommodating the smooth surface portion of the relatively movable component, forming a second bore in said second component substantially normal to the first bore, inserting in the second bore a substantially spherically-shaped body of nonmetallic material of a diameter less than the diameter of the second bore and to a depth wherein a portion of the body extends into the first bore, and moving the movable component in the first bore engaging and deforming the body thereby establishing substantial friction for frictionally retaining the movable component in adjusted positions.

5. The method of frictionally retaining a relatively movable threaded component in a threaded opening in a second component of a charge forming apparatus including forming a bore having a closed end in one of said components normal to the axis of movement of the threaded component, inserting in the bore a substantially spherically-shaped deformable resinous body of a lesser diameter than that of the bore and to a depth to effect normal interference with the threads of the other of said components, and moving the relatively movable threaded component into the threaded opening in the second component to engage and deform the resinous body establishing friction effective to hold the relatively movable component in adjusted positions.

6. The method of frictionally retaining a relatively movable threaded member in a threaded opening in a second member of a charge forming apparatus including forming a recess in one of the members laterally of the axis of movement of the threaded member, inserting in the recess a substantially spherically-shaped deformable resinous body of a size to be loosely received in the recess and to a depth to effect normal interference with the threades of the other of said members, and moving the threaded member in the threaded opening in the second member to engage and deform the resinous body establishing lateral pressure between the members providing substantial friction effective to hold the relatively movable threaded member in adjusted positions with respect to the second member.

7. In combination, charge forming apparatus including a first member, a second member mounted by the first member and relatively movable with respect to the first member, a recess in one of said members, a substantially spherically-shaped element of deformable material in said recess of a size to be loosely received in the recess, said spherically-shaped element engaging the other of said members, said spherically-shaped element being deformed by engagement with said other member establishing substantial friction for frictionally retaining the relatively movable member in positions to which it may be moved.

8. In combination, charge forming apparatus including a first member, a second member disposed in a bore in the first member and relatively movable with respect to the first member, a cylindrical recess in one of said members normal to the axis of the bore, a substantially spherically-shaped element of deformable material in said recess of a lesser diameter than the diameter of the recess, said spherically-shaped element engaging the other of said members, said spherically-shaped member being deformed by engagement with said other member establishing substantial friction for holding the relatively movable member in positions to which it may be moved.

9. In combination, charge forming apparatus including a first member having a threaded opening, a threaded member adapted to be received in the threaded opening, a recess in one of said members, a substantially spherically-shaped element of deformable material in said recess, said element being of a size to be loosely received in the recess, said spherically-shaped element engaging the other of said members, said spherically-shaped member being deformed by engagement with said other member establishing substantial friction for holding the relatively movable member in positions to which it may be moved.

10. The combination according to claim 9 wherein the spherically-shaped element is of resinous material.

11. In combination with fuel feed and charge forming apparatus including a first means providing a mixing passage, a control means associated with the mixing passage, a relatively adjustable member mounted by one of said means, a recess in one of said means, a spherically-shaped element of deformable nonmetallic material of a size to be loosely disposed in the recess and adapted to be engaged by said adjustable member, said spherically-shaped element being deformed by the engagement establishing substantial friction for frictionally retaining the adjustable member in adjusted positions for varying the relative position of the control means.

12. In combination with fuel feeding and charge forming apparatus including a first means providing a mixing passage, a control means associated with the mixing passage, a relatively adjustable threaded member mounted by one of said means, a recess in the means mounting the threaded member, a spherically-shaped element of deformable nonmetallic material in the recess of a size to be loosely disposed in the recess and adapted to be engaged by the threaded member, said spherically-shaped element being deformed by engagement with the threaded member establishing substantial friction for frictionally retaining the threaded member in adjusted positions for varying the relative position of the control means.

13. In combination with charge forming apparatus having a relatively movable control member, a second member mounted by the control member and relatively movable with respect to the control member, a cylindrical recess in one of said members, a substantially spherically-shaped element of deformable nonmetallic material in said recess, said spherically-shaped element being of a diameter less than the diameter of the recess and positioned to be engaged by the other of said members, and spherically-shaped element being deformed by engagement with the other member establishing substantial friction for frictionally retaining the second member in positions to which it may be moved.

14. The combination according to claim 13 wherein the material of the spherically-shaped element is nylon.

15. In combination with charge forming apparatus having a body mounting a control means, a threaded member mounted by the control means and relatively movable with respect to the control means, a cylindrical recess in the control means, a substantially spherically-shaped element of deformable nonmetallic material in said recess, said spherically-shaped element being of a diameter less than the diameter of the recess and positioned to be engaged by the threaded member, said spherically-shaped element being deformed by engagement with the threaded member establishing substantial friction for frictionally retaining the threaded member in positions to which it may be moved.

16. In combination with a carburetor having a body, said body having a mixing passage, a shaft extending diametrically of the mixing passage, said shaft being mounted in journal bores in the body, a valve member mounted on said shaft, a cylindrical recess in said body disposed transversely of and intersecting one of said bores, said cylindrical recess having a closed end, a substantially spherically-shaped element of deformable material in said cylindrical recess of a size to be loosely received in the recess adjacent the closed end, said spherically-shaped element being of a dimension extending into the adjacent journal bore, said shaft engaging and deforming the spherically-shaped body establishing substantial friction for frictionally retaining the shaft in adjusted positions.

17. The combination according to claim 16 wherein the material of the spherically-shaped element is nylon.

18. In a carburetor and fuel pump construction, in combination, a carburetor body, a pump body associated with the carburetor body, said carburetor body having a mixing passage, a shaft extending across the mixing passage, valve means mounted by the shaft, an arm mounted by said shaft, a threaded bore in one of the bodies, an adjustable threaded member in said threaded bore adapted to be engaged by said arm, a transverse bore intersecting the threaded bore, said bore having a closed end, and a spherically-shaped member of deformable material of lesser diameter than the diameter of the transverse bore disposed in the transverse bore between the closed end of the transverse bore and the adjustable threaded member, said spherically-shaped body extending into the threaded bore to an extent to be frictionally engaged and distorted by the threaded member for frictionally retaining the threaded member in adjusted positions.

19. In combination with fuel feed and charge forming apparatus including a fuel pump body and a carburetor body, said carburetor body having a mixing passage, a shaft extending across the mixing passage, a throttle valve mounted on the shaft, a plate mounted on the shaft exteriorly of the carburetor body, a projection on one of said bodies, a threaded opening in the projection, a threaded member in the threaded opening having a tapered portion adapted to be engaged in said plate, a transverse bore in said projection intersecting the threaded opening, said bore having a closed end, a substantially spherically-shaped element of deformable material in the bore adjacent the closed end, said element being of a diameter less than the diameter of the transverse bore and of a size to be engaged and deformed by the insertion of the threaded member in the threaded opening for frictionally retaining the threaded member in adjusted positions determining the engine idling position of the throttle valve.

20. The combination according to claim 19 wherein the spherically-shaped element is of substantially rigid resinous material.

21. In a carburetor and fuel pump construction, in combination, a carburetor body, a pump body secured to the carburetor body, said carburetor body having a mixing passage, a shaft extending across the mixing passage, valve means mounted by the shaft, an arm on the shaft, said pump body having a projection, a threaded bore in the projection, a threaded member in said threaded bore adapted to be engaged by the arm, a transverse bore in the projection intersecting the threaded bore, and a spherically-shaped member of resinous material of a diameter less than the diameter of the transverse bore disposed in the transverse bore, said bore being of a depth whereby said spherically-shaped member extends into the threaded bore to an extent as to be frictionally engaged and distorted by the threaded member for frictionally retaining the threaded member in adjusted position.

22. In a carburetor, in combination, a carburetor body having a mixing passage, a shaft extending across the mixing passage, valve means mounted by the shaft, an arm on the shaft, a projection on the body, a threaded bore in the projection, a threaded member in said threaded bore adapted to be engaged by the arm, a transverse bore in the projection intersecting the threaded bore, and a spherically-shaped member of resinous material of a diameter less than the diameter of the transverse bore disposed in the transverse bore, said bore being of a depth whereby said spherically-shaped member extends into the threaded bore to an extent to be frictionally engaged and distorted by the threaded member for frictionally retaining the threaded member in adjusted position.

23. In a carburetor and fuel pump construction, in combination, a carburetor body, a fuel pump body, said carburetor body having a mixing passage, a journally mounted shaft extending across the mixing passage, a throttle valve mounted on the shaft and disposed within the mixing passage, said shaft having a portion extending exteriorly of the carburetor body, an arm secured to said exterior portion of the shaft, a projection on one of said bodies, a threaded bore in said projection, a threaded member in said threaded bore having a tapered portion adapted to be engaged by said arm whereby adjustment of said threaded member varies the position of said arm and said throttle valve to regulate the engine idling position of the throttle valve, resilient means biasing the shaft to normally engage the arm with the threaded member, a cylindrical recess in said projection normal to the threaded bore and intersecting the threaded bore, and a spherically-shaped body of deformable material of a diameter less than the diameter of the recess disposed in said recess, said recess being of a depth whereby said spherically-shaped body extends into the path of the threads on the threaded member establishing friction effective to hold the threaded member in adjusted positions.

24. A charge forming apparatus and fuel pump construction including, in combination, a carburetor body, a fuel pump body, said carburetor body having a mixing passage, a journally mounted shaft extending across the mixing passage, a throttle valve mounted on the shaft and disposed within the mixing passage, said shaft having a portion extending exteriorly of the carburetor body, a projection secured on the exterior portion of the shaft, a projection on one of said bodies, one of said projections having a threaded bore, a threaded member in said threaded bore having a tapered portion adapted to be engaged with the other of said projections whereby adjustment of said threaded member varies the position of said throttle valve to regulate the engine idling position of the throttle valve, resilient means biasing the throttle valve toward engine idling position, a cylindrical recess in the projection having a threaded bore and intersecting the threaded bore, said cylindrical recess having a closed end, and a spherically-shaped element of deformable material of a diameter less than the diameter of the recess disposed in said recess extending into the path of the threads on the threaded member and being deformed by the threaded member establishing friction effective to hold the threaded member in adjusted positions.

25. In combination, charge forming apparatus including a first member formed with a mixing passage, fuel channel means in said first member for delivering fuel from a supply into the mixing passage, a second member mounted by the first member and relatively movable with respect to the first member for controlling fuel flow through the channel means, said second member having a threaded portion and a smooth surfaced portion, a bore in said first member having a threaded portion accommodating the threaded portion of said second member, a cylindrical recess in said first member normal to and intersecting the bore in the first member, said recess having a closed end, and a spherically-shaped element of deformable material in said recess of a size to be loosely received in the recess, said element being disposed in said recess adjacent the closed end, said spherically-shaped element engaging the smooth surfaced portion of the second member, said spherically-shaped element being deformed by engagement with the smooth surfaced portion of the second member establishing substantial friction for frictionally retaining the second member in various relative positions to which it may be moved.

26. In combination, charge forming apparatus including a first member formed with a mixing passage, fuel channel means in said first member for delivering fuel from a supply into the mixing passage, a second member mounted by the first member and relatively movable with respect to the first member for controlling fuel flow through the channel means, said second member having a threaded portion, a threaded opening in the first member accommodating the threaded portion of said second member, a cylindrical recess in one of said members normal to the axis of the second member, and a spherically-shaped element of deformable material in the cylindrical recess of a size to be loosely received in the recess, said spherically-shaped element engaging the threaded portion of the second member whereby engagement of the spherical element with the threads deforms the element establishing substantial friction for frictionally retaining the second member in various positions to which it may be moved.

27. In combination, charge forming apparatus including a first member formed with a mixing passage, fuel channel means in said first member for delivering fuel from a supply into the mixing passage, a second member mounted by the first member and relatively movable with respect to the first member for controlling fuel flow through the channel means, said second member having a threaded portion, a threaded opening in said first member accommodating the threaded portion of said second member, a cylindrical recess in said first member normal to and intersecting the threaded opening, said recess having a closed end, a spherically-shaped element of deformable material in said recess of a size to be loosely received in the recess, said element being disposed in the recess adjacent to the closed end, said spherically-shaped element engaging the threaded portion of the second member, said spherically-shaped element being deformed by engagement with the threaded portion of the second member establishing substantial friction for frictionally retaining the second member in various relative positions to which it may be moved.

28. In combination with a carburetor having a body, said body having a mixing passage, a journally mounted shaft extending across the mixing passage, a throttle valve mounted on the shaft and disposed within the mixing passage, means mounted on said shaft having a threaded opening, a threaded member in said threaded opening, said threaded member having a portion adapted for engagement with a surface associated with the carburetor body whereby manipulating of the threaded member regulates the engine idling position of the throttle valve, said means having a recess, a spherically-shaped member of nonmetallic deformable material loosely disposed in said recess, said spherically-shaped member being disposed whereby the threaded member engages and deforms the spherically-shaped member establishing friction effective to hold the threaded member in adjusted positions.

29. In combination with charge forming apparatus having a body, a relatively movable shaft supported in a bore in the body, a cylindrical recess in the body normal to and intersecting the bore, a substantially spherically-shaped element of deformable nonmetallic material of lesser diameter than the diameter of the recess disposed in said recess, said spherically-shaped element being disposed to be engaged by the shaft and deformed by engagement with the shaft establishing sufficient friction for frictionally retaining the relatively movable shaft in positions to which it may be moved.

30. In combination with a carburetor having a body, said body hving a mixing passage, a journally mounted shaft extending across the mixing passage, a throttle valve mounted on the shaft and disposed within the mixing passage, a plate mounted on said shaft having a U-shaped portion, the legs of the U-shaped portion having aligned threaded openings, a threaded member in said threaded openings, said threaded member having a portion adapted for engagement with a surface associated with the carburetor body whereby manipulation of the threaded member regulates the engine idling position of the throttle valve, a recess in the bight region of the U-shaped portion, a spherically-shaped element of nonmetallic deformable material loosely disposed in said recess, said recess being of a depth to position the element whereby the threaded member engages and deforms the element establishing friction effective to hold the threaded member in adjusted positions.

31. In combination, charge forming apparatus including a first component, a second component relatively movable with respect to the first component, a bore in one of the components, a recess in the component having the bore, said recess being normal to the bore, a substantially spherically-shaped element of deformable material loosely disposed in said recess, said spherically-shaped element engaging the relatively movable component, said recess being of a depth whereby said element is deformed by engagement with the relatively movable component establishing substantial friction for frictionally retaining the relatively movable component in positions to which it may be moved.

* * * * *